United States Patent [19]

Salomon

[11] 4,337,965

[45] * Jul. 6, 1982

[54] SAFETY BINDING ADAPTED TO BE MOUNTED ON A SKI

[75] Inventor: Georges P. J. Salomon, Annecy, France

[73] Assignee: S. A. Des Etablissements Francois Salomon & Fils, Annecy, France

[ * ] Notice: The portion of the term of this patent subsequent to Oct. 9, 1996, has been disclaimed.

[21] Appl. No.: 134,457

[22] Filed: Mar. 27, 1980

Related U.S. Application Data

[63] Continuation of Ser. No. 954,294, Oct. 20, 1978, abandoned, which is a continuation-in-part of Ser. No. 747,526, Dec. 6, 1976, abandoned.

[30] Foreign Application Priority Data

Dec. 11, 1975 [FR] France ..... 75 37908
Mar. 22, 1978 [FR] France ..... 78 08342

[51] Int. Cl.[3] ..... A63C 9/085
[52] U.S. Cl. ..... 280/628
[58] Field of Search ..... 280/623, 626, 625, 628, 280/629, 630

[56] References Cited

U.S. PATENT DOCUMENTS

| | | | |
|---|---|---|---|
| 3,822,071 | 7/1974 | Mottet | 280/625 |
| 3,902,728 | 9/1975 | Salomon | 280/629 |
| 4,170,372 | 10/1979 | Salomon | 280/626 |
| 4,178,014 | 12/1979 | Salomon | 280/629 |
| 4,260,175 | 4/1981 | Salomon | 280/629 |

FOREIGN PATENT DOCUMENTS

| | | | |
|---|---|---|---|
| 2214091 | 9/1973 | Fed. Rep. of Germany | 280/629 |
| 2364298 | 6/1975 | Fed. Rep. of Germany | 280/629 |
| 2655896 | 6/1977 | Fed. Rep. of Germany | 280/629 |

*Primary Examiner*—David M. Mitchell
*Attorney, Agent, or Firm*—Sandler & Greenblum

[57] ABSTRACT

A safety binding adapted to be mounted on a ski comprising a one-piece jaw in which engages and is maintained one end of the sole of a ski boot, the jaw being urged under the action of a resilient device against two support lines. The support lines, viewed along the axis of the ski, converge towards the point located above the ski.

13 Claims, 32 Drawing Figures

SAFETY BINDING ADAPTED TO BE MOUNTED ON A SKI

REFERENCE TO PRIOR APPLICATIONS

This is a continuation of application Ser. No. 954,294, filed Oct. 20, 1978, which is a Continuation-in-Part of application Ser. No. 747,526, filed Dec. 6, 1976, both now abandoned.

FIELD OF THE INVENTION

The present invention relates to a safety binding adapted to be mounted on a ski.

BACKGROUND OF THE INVENTION

Safety bindings, called front abutments, are known which comprise a one piece jaw in which engages and is maintained the front part of the sole of a ski boot. This jaw is maintained in contact against two lateral support lines disposed respectively on each side of the longitudinal axis of the ski and the jaw is urged towards the front of the ski under the action of a resilient member. As a result, the jaw can pivot on one or the other of the support lines when the foot of a skier is subjected to a torsional force in one direction or the other to insure release.

In this known safety binding, the two support lines are vertical, that is to say perpendicular to the upper surface of the ski. Such an arrangement has the disadvantage that, in certain instances of release of the safety binding, an increase in the release force is caused. This especially occurs in the course of a lateral release.

Indeed, as the sole engages under the edge of the jaw or the sole clip and the point of support is at the same horizontal level, there results a significant chafing of the sole under the edge, which chafing produces a resisting force opposing movement with a resulting increase in the release force. Due to this, good functioning of the security binding is prevented.

SUMMARY OF THE INVENTION

The present invention has for an object the obviating or mitigating of these disadvantages by providing a simple particular mounting of the jaw.

According to the present invention, there is provided a safety binding for a ski comprising a one-piece jaw in which can be engaged and maintained one end of the sole of ski boot, a support means connectible to a ski and providing two lateral support lines disposed respectively on either side of the longitudinal plane of symmetry of the ski, resilient means urging the jaw against the support lines so that the jaw can pivot on either line of support, the lines of support viewed along the axis of the ski converging towards a point disposed above the ski, and means for retaining said jaw on said support means in the course of pivoting of the jaw around one of the support lines.

Due to the particular disposition of the support lines of the jaw of the security binding according to the invention, this jaw, during its pivotal movement around one of the lines of support during a release operation, lifts slightly in the direction of release which practically obviates the chafing due to the vertical urging of the binding during lateral release and consequently does not cause an increase in the release force.

BRIEF DESCRIPTION OF DRAWINGS

Embodiments of the present invention will now be described by way of example, with reference to the accompanying drawings, in which.

DETAILED DESCRIPTION

Figure 1:
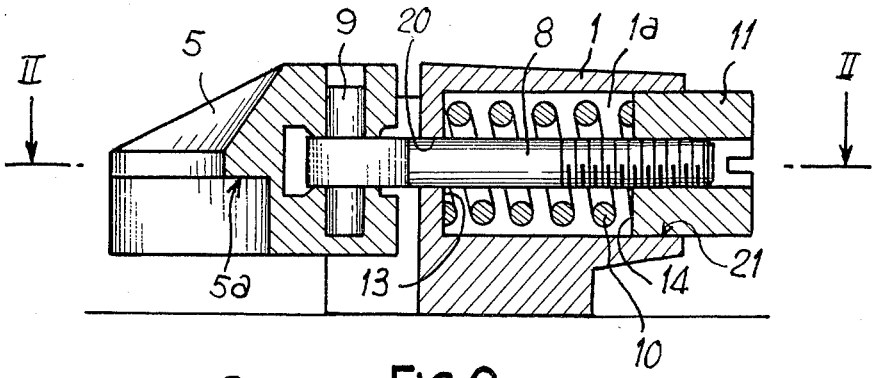
FIG. 1 is a vertical axial section of a safety binding according to the invention.
Figure 2:
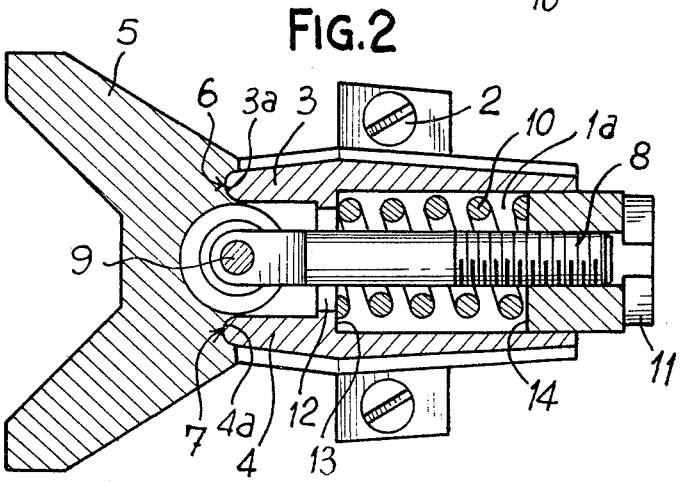
FIG. 2 is a horizontal sectional view taken on line II—II in FIG. 1.
Figure 3:
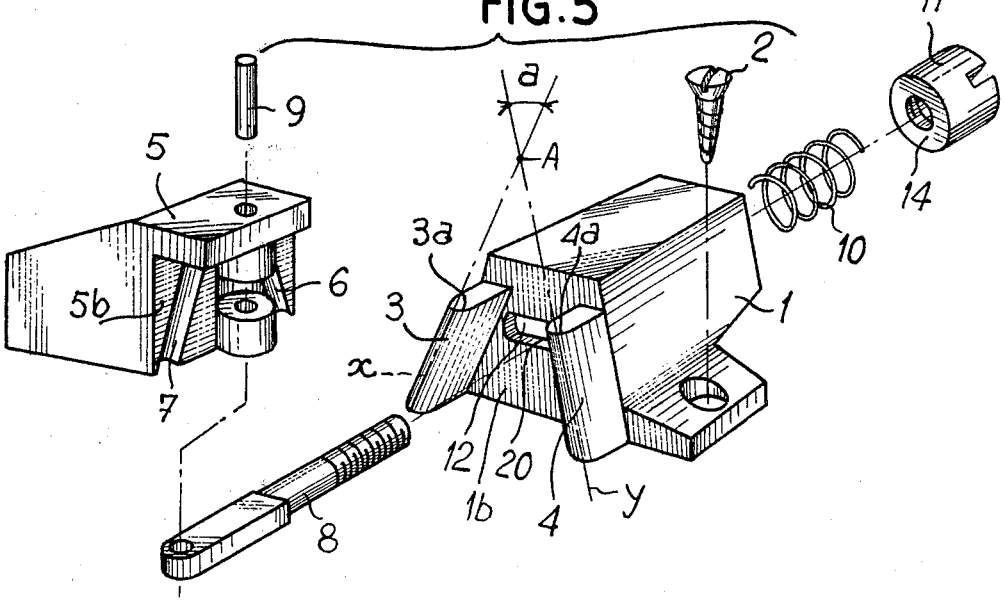
FIG. 3 is a schematic exploded perspective view of the safety binding of FIGS. 1 and 2.

The safety binding according to one embodiment of the invention as is shown in FIGS. 1 to 3, comprises a support constituted by a body 1 which is fixed on the upper surface of a ski by means of screws 2. This body comprises a rear transverse will 1*b* from which extend, towards the rear, two ribs 3 and 4 integral with the body 1 or connected thereto. These ribs are rounded at their ends to form respective cylindrical surfaces 3*a* and 4*a* of small diameter, the axes x and y of which constitute lines of support for a jaw 5. In the description which follows, reference will be made to lines of support x and y it being understood that they act as theoretical pivotal axes for the jaw 5, these axes being provided by the body 1, fixed on the ski.

According to the fundamental characteristic of the invention, the two support lines x and y viewed along the axis of the ski converge at a point A disposed above the ski. The two support lines x and y are symmetrical with reference to the longitudinal plane of symmetry of the ski and in this case they intersect at point A by subtending between them an angle a. In this case, the two support lines x and y are located in the same transverse plane.

However, this arrangement is not limitative and the two support lines x and y need not be located in the same transverse plane, that is to say, they may be offset. The jaw 5 is in one piece and presents two wings extending above the front part of the sole of a ski boot which they engage by an edge 5*a*.

The jaw 5 presents, in its front face 5*b* transverse relative to the body 1, two recesses 6 and 7 of a form corresponding to the two support surfaces 3*a* and 4*a*. These recesses are thus preferably constituted by semi-cylindrical grooves of the same diameter as that of the support surfaces 3*a* and 4*a*, and the axes of which are symmetrical relative to the longitudinal plane of symmetry of the ski and subtending between them the same angle a.

A threaded rod 8 articulated on the jaw 5 around a central vertical axis or pin 9 maintains the jaw in contact with the body 1 thanks to a spring 10 located in a longitudinal bore 1*a* of the body 1 and disposed between the end 13 of this bore and a support face 14 on a button or stud 11 screwed on the screw-threaded extremity of the rod 8. The button 11 serves also as a tension regulating screw for the spring 10.

The rod 8 extends through the longitudinal bore 1*a* and it traverses the transverse wall 1*b* of the body which is opposite the jaw 5 by passing through a hole 12 which is elongate in the transverse direction.

Thus, upon a lateral release in one direction or the other, the jaw pivots on the support line x in the case of a release to the left or on the support line y in the case of a release to the right in opposition to the action of the return spring 10 which is compressed between the base 13 of the bore 1*a* and the support face 14.

The vertical maintenance of the jaw 5 on the support surfaces 3*a* and 4*a* is assured by the rod 8 which is itself secured in the body in the vertical direction. For this purpose, the rod 8 is maintained vertically in the central part of the hole 12 by the upper edge 20*a* of the latter which is raised slightly in the lateral sense; that is to say, to the left and to the right, to permit a slight ascending movement of the rod 8 when the jaw pivots towards the left or towards the right. The rod 8 is also maintained in the body by the button 11 which bears by its peripheral surface 21 against the internal surface of the bore 1*a*.

According to a modification, one can reverse the disposition of the support surfaces 3*a*, 4*a* and the grooves forming recesses 6 and 7 by providing the surfaces on the jaw 5 and the grooves in the body 1.

The height control of the mounting can be effected by means of a sole clip controllable by a screw mounted on the jaw 5 as is common in safety bindings.

Figure 4:
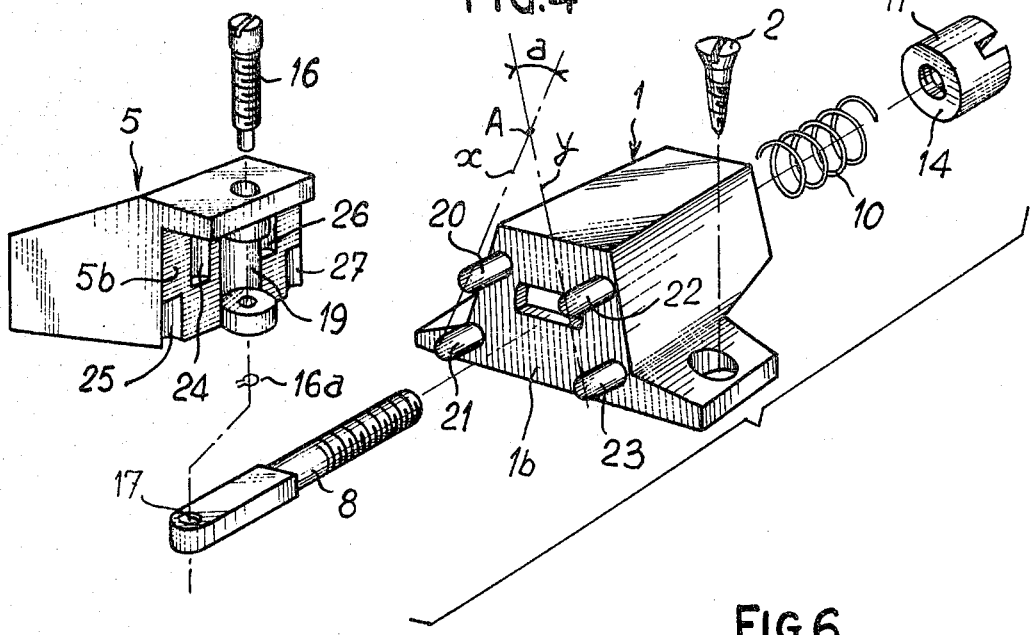
FIG. 4 is an exploded perspective view of a modification of the safety binding according to the invention.

Sometimes this control can be realized in the manner shown in FIG. 4. In this case, the axis of rotation 9 between the rod 8 and the jaw 5 is replaced by a screw 16 which is engaged in a tapped hole 17 provided in the rear end of the screw rod 8.

This rear end engages in a vertical recess 19 provided in the front transverse face 5*b* of the jaw 5 to permit vertical displacement of the latter relative to the rod 8. In this case, the support lines x and y are provided by the alignment for each of them of two bosses or stems 20, 21 for the support line x and 22, 23 for the support line y. The two support lines subtend between them an angle a and intersect at point A as in the case of the binding illustrated with reference to FIGS. 1 and 3. These bosses or stems 20 to 23 have any suitable form, for example spherical, conical, cylindrical, cubic, etc. They extend towards the rear and engage in respective vertical recesses 24, 25, 26, 27, provided in the front face 5*b* of the jaw 5. Dependent on the form of the bosses or stems and their recesses it is possible to produce upon a pivoting of the jaw 5 around one of the support lines x, y, a relative displacement of one of the pairs of bosses 20, 21 or 22, 23 in their respective recesses 24, 25 or 26, 27.

The screw 16 which permits the height regulation of the jaw 5 is locked against withdrawal from this jaw after its assembly with the screw rod 8, for example, by means of a circlip 16*a*, or by rivetting.

It is to be noted that in embodiment of FIG. 4, the lower support bosses or stems 21, 23, are in the same parallel plane as the surface of the ski and the same applies to the upper bosses or stems 20, 22.

In a modification, the support bosses or stems 20 and 22 could be merged into a single support.

According to a modification, the support bosses or stems 20 to 23 could be carried by the jaw 5 and the recesses 24 to 26 could be provided in the transverse face 1*b* of the body 1.

In the mounting illustrated on FIG. 4, the vertical securement of the jaw is effected by means of the rod 8 as in the case of the mounting of FIGS. 1 to 3.

Figure 5:
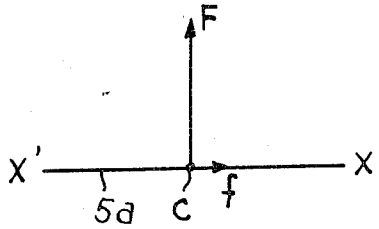
FIGS. 5 and 6 are diagrams respectively illustrating the decaying of the vertical force of a boot on the jaw in the case of a known binding and in the case of the binding according to the invention.
Figure 6:
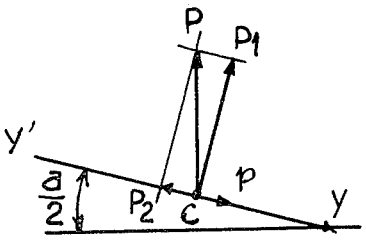

There will now be explained, with particular reference to FIGS. 5 and 6, the advantageous results which obtain from the converging disposition of the support lines x and y. In safety bindings, the vertical retention of the boot is generally effected by the edge 5*a* of the jaw or by a sole clip. Let C be the point or points of contact of the boot on this edge.

In a known safety binding (diagram of FIG. 5) the trajectory $X—X_1$ of the points of contact C of the boot on the jaw during release is parallel to the plane of the ski. The vertical force F applied by the boot on the edge 5*a* thus give, during release of the boot, a frictional force f because there is relative displacement of the boot and jaw. The direction of release being X towards $X_1$, the friction f thus provides a resisting force opposing movement with an increase in the releasing force.

On the contrary, in the safety binding according to the invention (diagram of FIG. 6) due to the fact that the lines of support x and y are inclined, the trajectory of the points of contact C follow the line $Y—Y_1$ which is inclined at an angle a/2 relative to the plane of the ski. The force P applied by the boot on the edge 5*a* during release is resolved, into two forces P1 perpendicular to $Y—Y_1$ and P2 along $Y—Y_1$. The force P1 produces a frictional force p opposing movement but which can be largely compensated for by the force P2 which is in the direction of movement. There is thus, in this case, no increase in the releasing force.

There will now be described, with reference to FIG. 7, a further embodiment of the binding according to the invention. In this case, the jaw 28 is integral with a casing 29 of the binding which has a bore 30 in which is disposed the spring 31 of the binding.

The jaw 28 rests, as in previous cases, on two converging lines of support x and y formed by two ribs 3 and 4 extending towards the rear and integral with a support member 32 integral with a base plate 33 fixed to the ski. The support member 32 extends vertically in the interior of bore 30 and the ribs 3 and 4 with round surfaces are disposed in converging grooves 6 and 7 of corresponding form provided in the transverse 29*a* of the casing 29 which constitutes the end of the bore 30 and the separation between the jaw 28 and the casing 29.

The loading of the binding comprises, beside the spring 31, an axial piston 34 which is slidably mounted at the front in a hole formed in the front transverse wall 29*b* of the casing 29 and which has at its rear a transverse collar 35. The spring 31 is thus compressed between this transverse collar 35 and the wall 29*b*. The collar 35 is extended towards the rear by an end part 36, preferably conical, which engages in the bottom of a recess 37, also preferably conical, provided in the front face of the support member 32. This support member 32 is reduced in cross-sectional area externally towards the front to facilitate rotation of the jaw 28.

Figure 7:
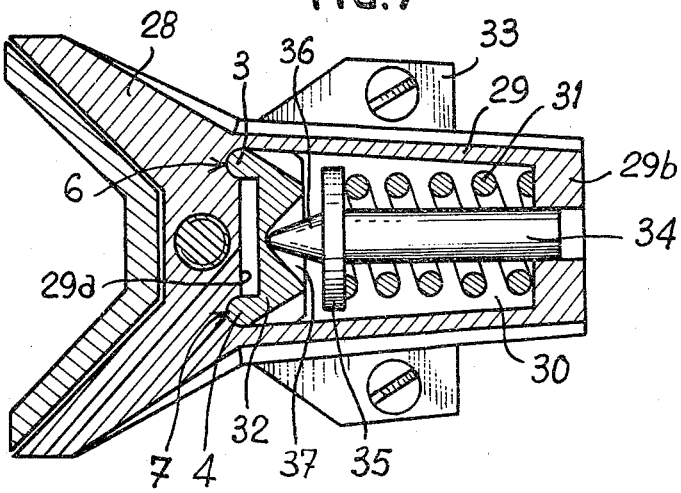
FIG. 7 is a horizontal sectional view of another modification of a binding according to the invention.

The functioning of the safety binding shown in FIG. 7, upon a release to right or to left, is the same as the other embodiments previously described. In the case of the binding of FIG. 7, the height control can be effected by means of a sole clip regulated by a screw mounted on the jaw.

Also in the case of this binding, the lower front face of the casing must not have a form which could impede rotation of the assembly formed by it and the jaw 28. Indeed, certain points of the lower face of the casing have a descending trajectory upon release.

The invention is not limited to the above embodiments; in particular the binding could be used to maintain the rear of the boot. In this case, they must assure, in addition to a lateral release, a vertical release. Moreover, the jaw should be able to co-operate with a member attached temporarily or not on the boot.

With reference to FIGS. 8 to 17, a variant embodiment of the safety binding according to the invention will now be described, which constitutes an abutment for the front of a ski boot 113. It comprises a body or casing 101 which is movably mounted on a fixed part 102 forming support on which it is held elastically in abutment. This support means 102 is fast with a base plate 103 which is fixed on the upper surface of a ski 104, for example by means of screws 105. The body 101 is held elastically in abutment on the fixed support 102 due to an elastic device comprising a piston 106 urged by a compression spring 107 which is permanently applied under pressure by this spring against the front face 102*b* of the support means 102. The compression spring 107 which extends axially inside the body 101 abuts, moreover, at its front end, on the bottom 108 of an adjusting plug 109 screwed at the front of the body. The piston 106 is mounted to slide in a bore 110 disposed in the front part of the body 101, along the longitudinal axis thereof.

The piston 106 is preferably constituted by a cylindrical sleeve of revolution comprising a rear support face 111 which is applied against the front face 102*b* of the support means 102.

A jaw 112 which is fast with the body 101 and in fact constitutes the rear part of said latter, maintains the front of the ski boot 113. The boot is maintained laterally due to the substantially vertical faces 114 and 115 of the wings of the jaw 112 and vertically due to a horizontal flange 116 of this jaw.

Figure 8:
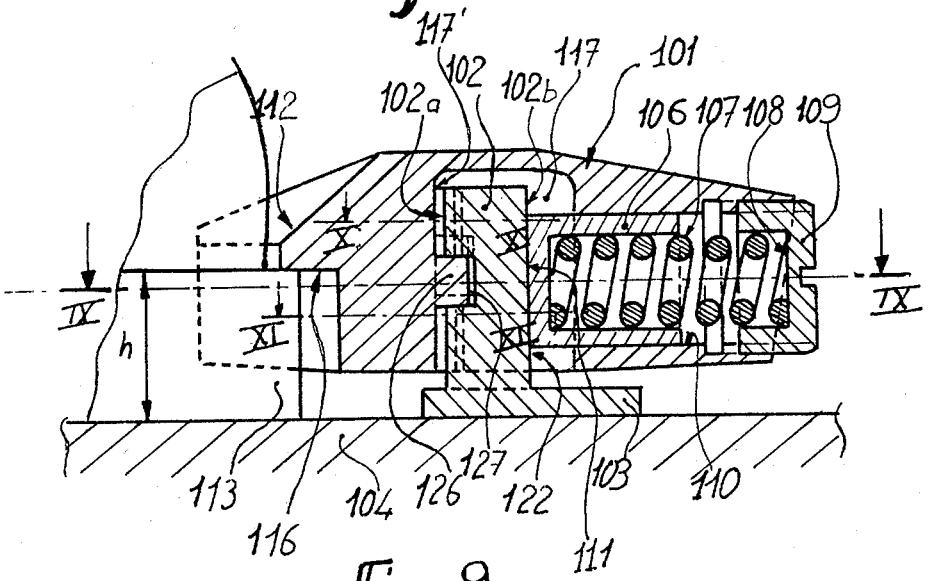
FIG. 8 is a view in vertical axial section of a variant embodiment of a safety binding according to the invention.
Figure 9:
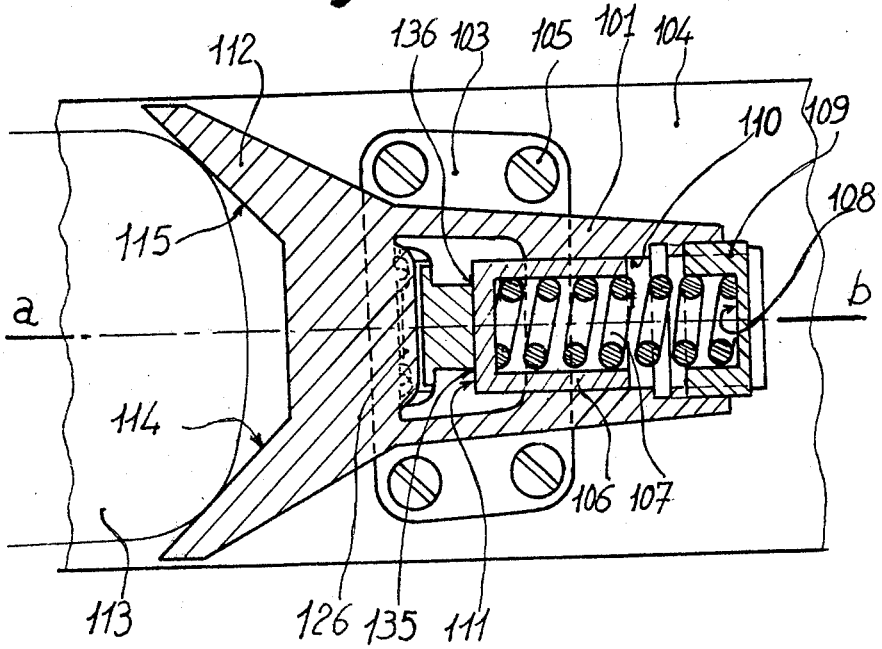
FIG. 9 is a horizontal sectional view taken on line IX—IX of FIG. 8.

As may be seen in FIGS. 8 and 9, the body 101 has a central recess 117 in which is engaged the support means 102. This recess 117 is substantially parallelpipedic in form and it is open downwardly, i.e. in the direction of the ski 104. The dimensions of this recess are such that the pivoting of the body 101 is possible on the two sides, as may be seen in particular in FIG. 13.

Figure 10:
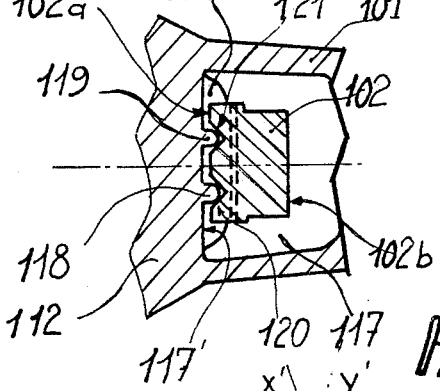
FIG. 10 is a partial horizontal sectional view taken on line X—X in FIGS. 8 and 12, the piston not being shown.
Figure 11:
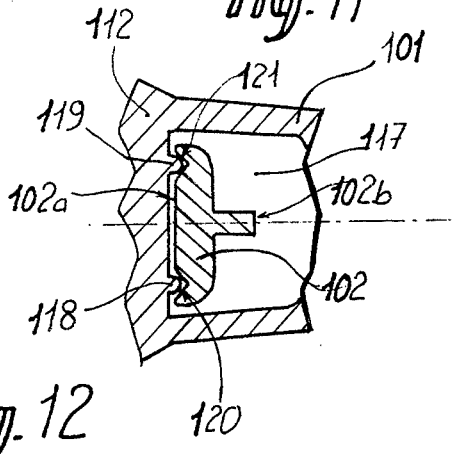
FIG. 11 is a partial horizontal sectional view taken on line XI—XI in FIGS. 8 and 12, the piston not being shown.
Figure 12:
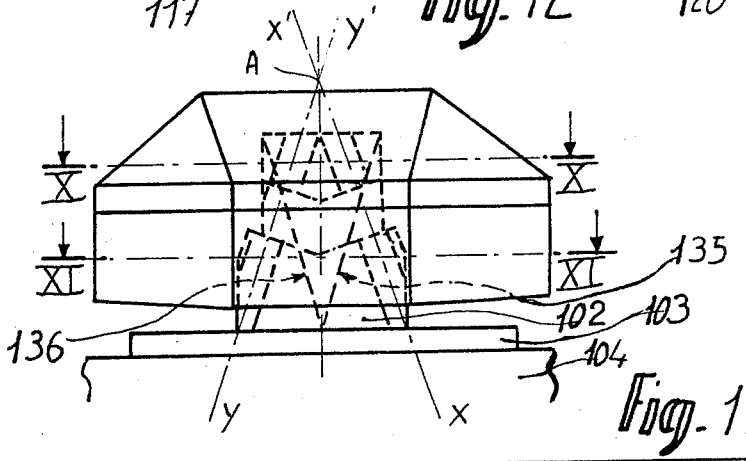
FIG. 12 is a view in elevation of the binding of FIGS. 8 to 11 along the longitudinal axis of the ski.
Figure 14:
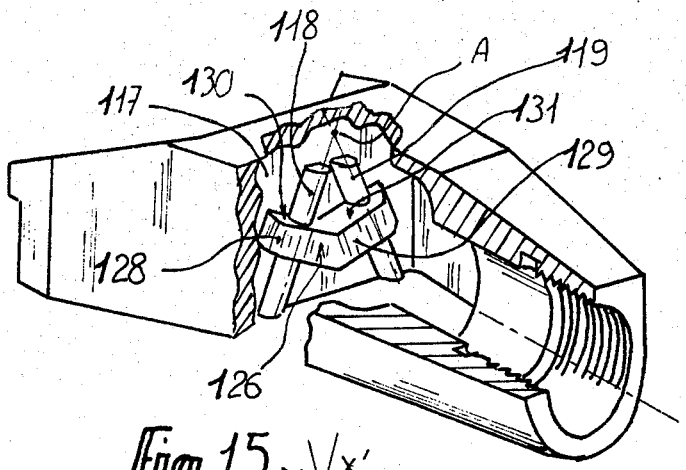
FIG. 14 is a perspective view, with parts broken away, of the one-piece jaw-casing assembly.
Figure 15:
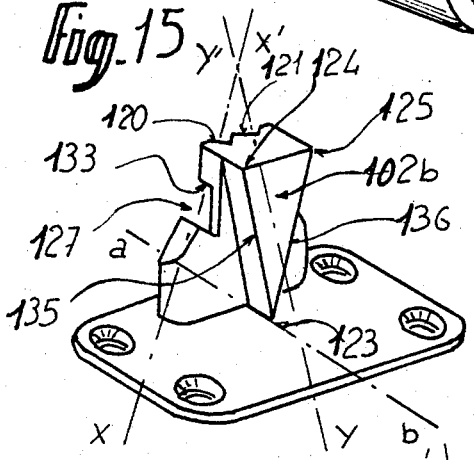
FIG. 15 is a perspective view showing the front face of the support means.

The inner and rear face 117' of the recess 117, i.e. the one located on the jaw 112 side, presents two forwardly projecting sections 118 and 119 (FIGS. 10, 11 and 14). These two projecting sections constitute two ribs which advantageously converge at a point A (FIGS. 12 and 14) above the ski.

When the body 101 is in normal position of use or in rest position, the two ribs (projecting sections) 118 and 119 take their place in two corresponding grooves or hollow sections 120 and 121 provided in the rear face 102*a* of the support means 102 and which converge at point A located above the ski.

The two ribs 118 and 119 thus engaged in the two grooves 120 and 121 thus define two support lines X—X' and Y–Y' converging at point A.

Figure 18:
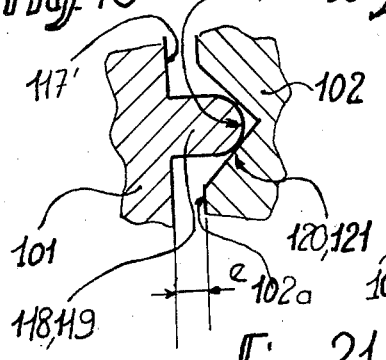
FIGS. 18, 19 and 20 are partial horizontal sectional views, on a larger scale, of three variant embodiments of the mode of support of the one-piece jaw-casing assembly on the fixed support means.

The ribs 118 and 119 may present rounded cross-sections, indicated by 118' and 119' in FIG. 18, the grooves 120 and 121 having for example a V-shaped cross section.

A sufficient space e is provided between the rear face 117' of the recess 117 and the rear face 102*a* of the support means 102, to allow the pivoting movement of the ribs 118, 119.

The holding of the body 101 in abutment on the rear face 102*a* of the support means 102 is effected due to the elastic device which is disposed towards the front with respect to the fixed support means 102 and which comprises the piston 106 urged rearwardly by the spring 107. This piston 106 is thus permanently in elastic abutment against the front face 102*b* of the support means 102.

This front face 102*b* is preferably flat and included in a plane parallel to the plane defined by the support lines X—X' and Y—Y'. This support face has the form of an isosceles triangle with downwardly directed vertex (FIG. 15), and the apices of which are indicated by 123, 124, 125. According to the invention, the edge 135 which is between the upper apex 124 and the lower apex 123 of the triangular front face 102*b* is parallel to the support line Y—Y′, while the other edge 136 between the other upper apex 125 and the lower apex 123 is parallel to support line X—X′.

It should be noted that the support line X—X′ and the edge 136 are on either side of the longitudinal plane of symmetry a–b perpendicular to the ski and that the same applies to the other support line Y—Y′ and the edge 135.

The vertical retention of the body 101 with respect to the fixed support means 102 is effected by means of a boss 126 (FIGS. 8, 9, 10, 13, 14) which extends forwardly from the rear face 117′ of the recess 117 and which is engaged in a corresponding housing 127 made in the rear face 102*a* of the support means 102.

As may be seen in FIG. 14 the boss 126 in fact comprises two projecting sections 128 and 129 corresponding respectively to the ribs 118 and 119. These projecting sections extend substantially perpendicularly to the axis of the ribs 118 and 119, i.e. to the support lines X—X′ and Y—Y′, so that the boss 126 has, as a whole, the shape of a V which is very widely open upwardly.

The projections 128 and 129 respectively define upper retaining flanges 130 and 131 (FIG. 14). These flanges 130 and 131 are in planes respectively perpendicular to the axis of ribs 118 and 119.

The hollow section 127 made in the rear face 102*a* of the support means 102 and with which the boss 126 cooperates, defines two upper flanges 133 and 134 for vertical retention, the upper flange 133 being perpendicular to the support line X—X′ and the flange 134 being perpendicular to the other support line Y—Y′.

Figure 13:
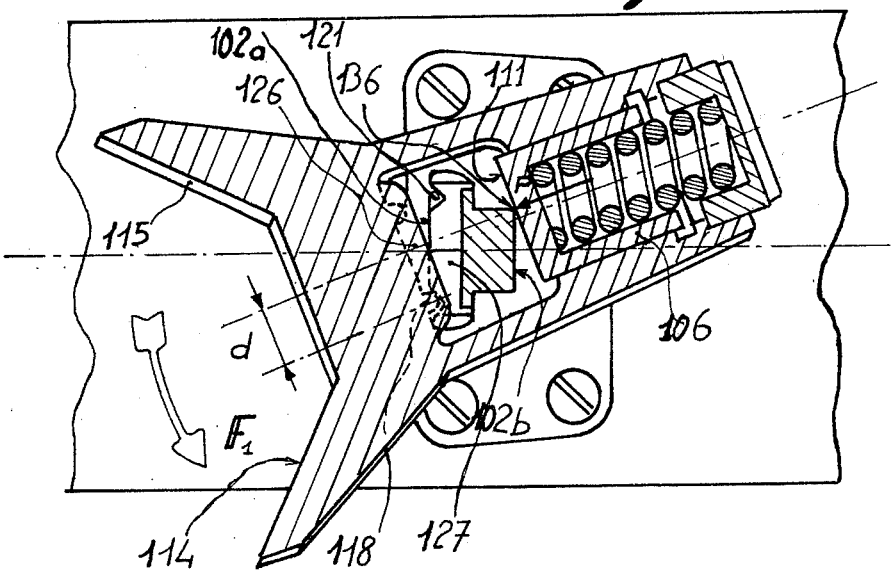
FIG. 13 is a horizontal sectional view similar to that of FIG. 9, the binding being in the course of lateral release.

Upon lateral release, the jaw 112 and casing or body 101 assembly pivots either on one of the support lines X—X′ or on the other, Y—Y′, depending on the direction of release. This pivoting is effected elastically against the action of the elastic device acting by action of the piston 106 against the front face 102*b* of the support means 102, along a line of reaction. FIG. 13 illustrates a lateral release to the right, in the direction of arrow $F_1$.

It is seen that, for such a release, the jaw pivots on the support line X—X′ formed by the rib 118 housed in the groove 120. The other rib 119 is then separated from the corresponding groove 121. It is seen that, in the case of such a pivoting, the rear face 111 of the piston 106 is in contact with the edge 136 of the front face 102*b* of the fixed support means 102.

The force exerted by the compression spring being P, the torque resisting the release is a function of Px d, d being the distance of application of the force P (FIG. 13).

It should be noted that, upon a lateral pivoting, the jaw has a somewhat particular movement due to the inclination of the support line X—X′ or Y—Y′, thus of the axis of pivoting.

The adjustment in height allowing the adaptation of the abutment to the different thickness of sole h (FIG. 8) may be effected by means of different devices which, being well known per se, will not be described in detail. This adjustment may be made, for example, by means of an adjusting screw displacing either the jaw 112 or a part of the jaw with respect to the body or casing 101, or the one-piece casing 101 and jaw 112 assembly with respect to the part of the casing bearing the ribs 118, 119 and the boss 126, or the assembly of the casing with the support means 102 with respect to the base plate 103.

Figure 19:
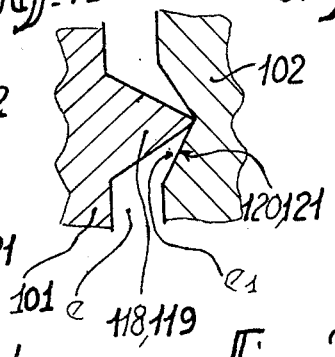
Figure 20:
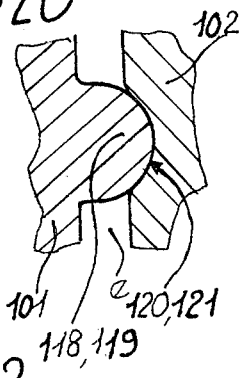

FIG. 19 and 20 show other embodiments of the support lines. In FIG. 19, the ribs 118 and 119 each have a V-shaped cross-section, whilst the corresponding grooves 120, 121 also have a V-shaped cross-section more open than the preceding, spaces e and $e_1$ being provided to allow the pivoting of the body or casing 101 in the two directions with respect to the support means 102.

In the variant embodiment illustrated in FIG. 20, the ribs 118, 119 and the respective grooves 120, 121 all have a circular cross-section and, there again, a space e is provided to allow the pivoting of the casing 101 with respect to the support means 102.

Figure 21:
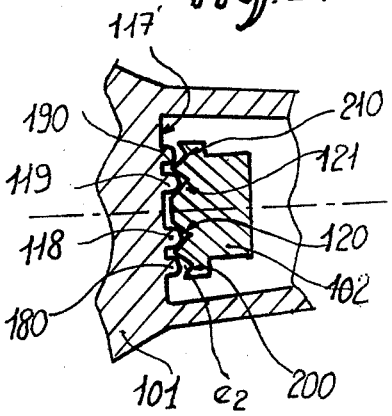
FIGS. 21 and 22 are partial horizontal sectional views of another variant embodiment of the mode of support, FIG. 21 being a view in rest position and FIG. 22 being a view in position of lateral release of the binding.
Figure 22:
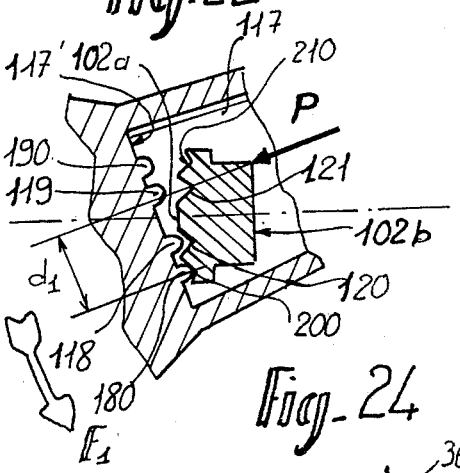
Figure 23:
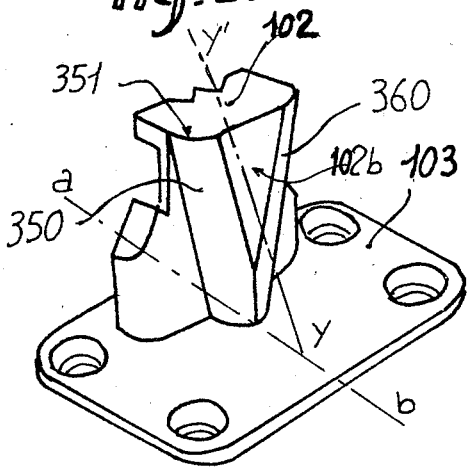
FIG. 23 is a view in perspective of a variant embodiment of the fixed support means.
Figure 24:
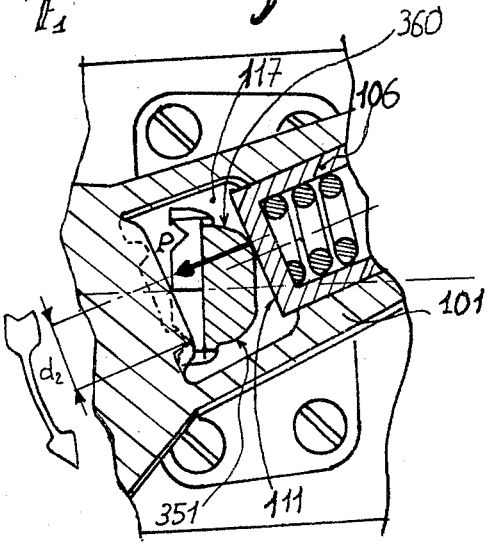
FIG. 24 is a partial horizontal sectional view of a binding comprising a fixed support means as illustrated in FIG. 23, in the course of lateral release.

FIGS. 21 and 22 show variant embodiments of the support lines, while FIGS. 23 and 24 illustrate variant embodiments of the lines of reaction.

These variants allow certain variations of the resistant torque by modification, during release, of the lever arm d (FIG. 13) on which is applied the force P of the compression spring 107, and/or by modification of this force P.

In the variant embodiment illustrated in FIGS. 21 and 22, the body or casing 161 of the binding comprises, in addition to ribs 118 and 119, two other ribs, namely a rib 180 parallel to the rib 118 and a rib 190 parallel to rib 119. The two additional ribs 180, 190 are disposed outwardly with respect to the first ribs 118, 119. In the same way, the fixed support means 102 comprises, in addition to the two grooves 120 and 121, two additional grooves located outwardly with respect to the preceding ones, namely a groove 200 parallel to groove 120 and a groove 210 parallel to groove 121.

In the rest position illustrated in FIG. 21, the body 101 is maintained in abutment on the rear face 102*a* of the fixed support means along the two support lines materialised on the one hand by the rib 118 engaged in the groove 120 and on the other hand by the rib 119 engaged in the groove 121. It will be noted that a space $e_2$ is, in this position, arranged between each of the lateral complementary ribs 180, 190, and the bottom of the associated additional groove 200, 210 to allow, in a first stage, the pivoting about one of the two support lines mentioned. With such an arrangement the lateral release is effected in two stages (FIG. 22). The first stage of release is effected by pivoting or by abutment, for example, of the rib 118 in the groove 120, as in the case of FIG. 21, and the second stage is effected by pivoting of the complementary rib 180 in the corresponding groove 200, the preceding rib 118 then separating from its groove 120. Thus, during this second phase of the release, the resistant torque is a function of $P \times d_1$, $d_1$ being the distance between the axis along which the force P of the compression spring 107 is applied and the support line between the complementary rib 180 and the corresponding groove 200.

FIGS. 23 and 24 illustrate a variant embodiment of the front face 102*b* of the support means 102.

In the embodiments described previously, the edges 135 and 136 of the support means 102 are fixed with respect thereto, but they constitute, with respect to the piston, lines of reaction which move with respect to the rear face 111 of the latter in the course of a release.

In the variant embodiment illustrated in FIGS. 22 and 24, the lines of reaction in the course of a release move on the fixed means 102. To this end, this fixed piece presents, on its front face 102*b*, two reaction surfaces 350 and 360, symmetrical to each other with respect to the longitudinal plane of symmetry a—b perpendicular to the ski.

The reaction surface 350 is a curved surface which is produced by a line of reaction which moves on a curve, for example the curve 351, whilst remaining parallel to the support line Y—Y'. With such an arrangement, in the course of a release, the rear face 111 of the piston 106 is in abutment on the fixed means 102 along a line of reaction which moves on the front face of this means, whilst always remaining parallel to the support line Y—Y'. The distance $d_2$ between the direction of application of the force P of the compression spring 107 and the support line constituting the axis of pivoting varies in the course of release, this differing from what happens in the case of FIG. 13 where the distance d remains constant.

The reaction surfaces 350 and 360 may be such that there is, or is not, relative displacement of the instantaneous line of reaction with respect to the piston 106.

It should be noted that the arrangement illustrated in FIGS. 21 and 22 and that of FIGS. 23 and 24 may be used simultaneously.

Figure 16:
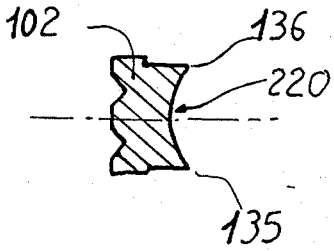
FIG. 16 is a partial horizontal sectional view, i.e. along a plane parallel to the ski, of the fixed support means, showing a variant of the front face thereof.
Figure 17:
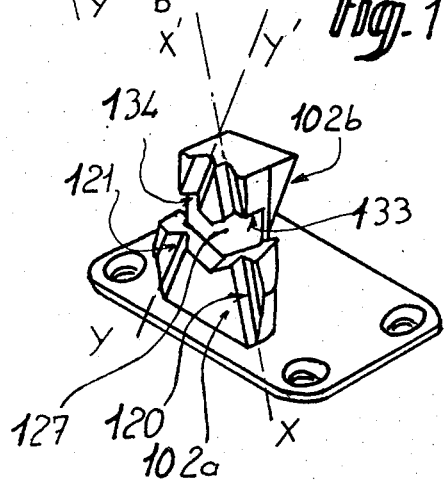
FIG. 17 is a perspective view showing the rear face of the fixed support means.

It should also be noted that the front face of the support means 102 could present a central hollow part 220, so that, in rest position, the piston 106 is really applied only on the two convergent edges 135 and 136 constituting the lines of reaction (FIG. 16).

It is obvious that the various embodiments of the invention which have been given hereinabove, with reference to the accompanying drawings, have been given solely by way of indicative and non-limiting example and that numerous modifications may be made without departing from the scope of the invention. In particular, the ribs and grooves in which these ribs engage could be inversed, the support means then presenting said ribs and the grooves being provided in the one-piece jaw and casing assembly. The same may also apply for the vertical retention sections.

Furthermore, the piston 106 pressed elastically against the front face **102*b* of the support means 102** could be replaced by any other elastically urged member, for example by a piece movable in rotation about a pin fast with the casing.

Figure 25:
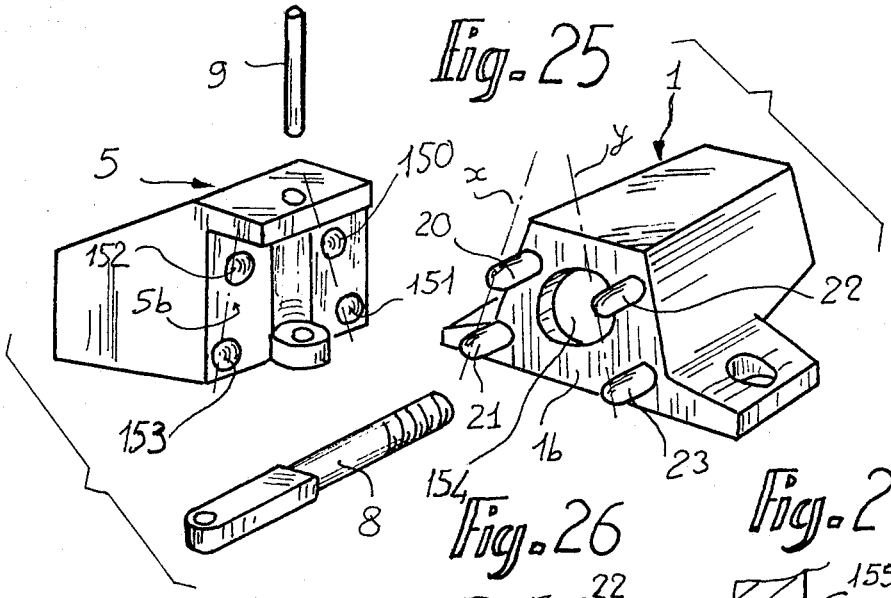
FIG. 25 is an exploded perspective view of another modification of the safety binding according to the invention.

FIG. 25 is a view similar to FIG. 4 and shows the body 1 comprising omits rear transverse wall **1*b*, four projections 20, 21, 22, 23, the two projections 20 and 21 materialising the line of support x and the two projections 22 and 23 materialising the line of support y. The wall 1*b* also comprises a hole 154 allowing free passage and movement of the rod 8. The front rear wall 5*b* of the jaw 5 comprises four housings 150, 151, 152, 153. The housing 150 cooperates with the projection 20, housing 151 with projection 21, housing 152 with projection 22 and housing 153 with projection 23**.

The vertical retention of the jaw 5 is therefore ensured by the cooperation of the recesses constituting the housings 150–153 with the projections 20–23, while allowing a lateral pivoting about axes x and y.

Figure 26:
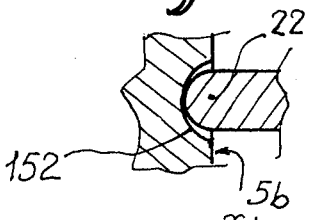
FIGS. 26 and 27 are partial horizontal sectional views, on a larger scale, of two embodiments of the mode of support of the jaw on the fixed support means.

FIG. 26 shows an embodiment of said cooperation.

Figure 27:
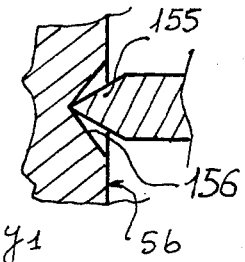

FIG. 27 shows another embodiment of said cooperation, the latter being effected by a conical projection 155 cooperating with a recess 156, likewise conical but of which the apex angle is larger to allow the lateral pivoting.

Figure 28:
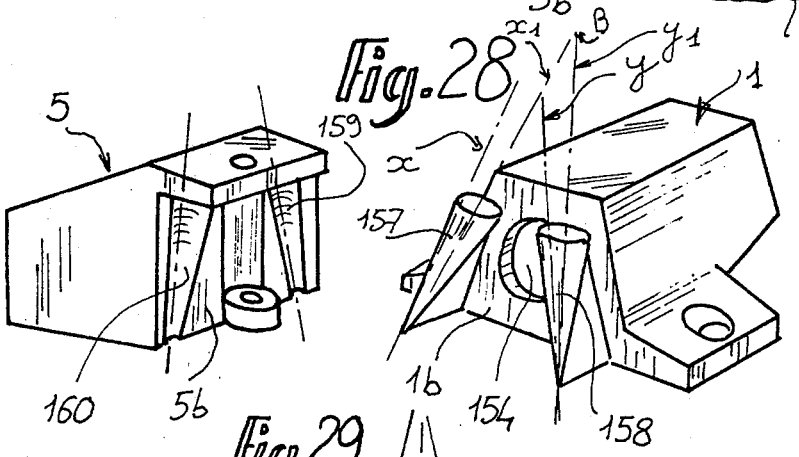
FIG. 28 is an exploded perspective view of another modification of the safety binding according to the invention.
Figure 29:
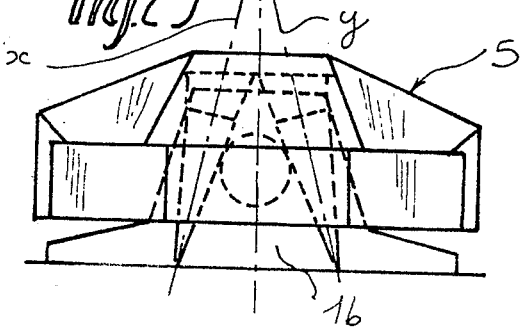
FIG. 29 is a view in elevation of the binding of FIG. 28 along the longitudinal axis of the ski.

FIGS. 28 and 29 show another embodiment of the lines of support.

FIG. 28 is a view similar to FIG. 25. The rear transverse wall **1*b* of the body 1 comprises two projecting cones 157 and 158 and, therebetween a hole 154 allowing the passage and displacements of the rod 8 (not shown). The projecting cones 157 and 158 materialise the lines of support x and y and, to this end, their axes $x_1$ and $y_1$ are forwardly inclined with respect to the ski and converge above the ski, for example at a point B. The lines of support x and y are thus advantageously located in a transverse plane perpendicular to the ski. The apices of two cones 157 and 158 face downwardly and, in order to ensure the vertical retention of the jaw 5, they cooperate with recesses 159 and 160 of complementary shape, made in the front transverse wall 5*b*** of the jaw.

FIG. 29 is a view along the axis of the ski, and towards the front, of the embodiment of FIG. 28.

Figure 30:
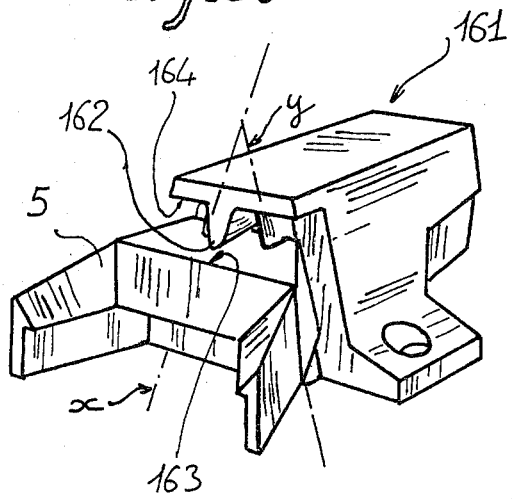
FIG. 30 is an exploded perspective view of another modification of the safety binding according to the invention.

FIG. 30 is a perspective view of another embodiment of vertical retention of the jaw. In this embodiment, the support means 161 presents, on its rear transverse wall, any lines of support x and y, for example such as those of FIG. 3. The vertical retention is effected with respect to said support means due to a projection 162 fast with the upper part of the means 161 and disposed above the jaw along the longitudinal axis of symmetry. This projection 162 also extends downwardly and is in contact, by its lower end, with the upper face 163 of the jaw. Inversely, the projection 162 may be fast with the upper face 163 of the jaw 5 and abut beneath the upper face 164 of the support means 161.

Figure 31:
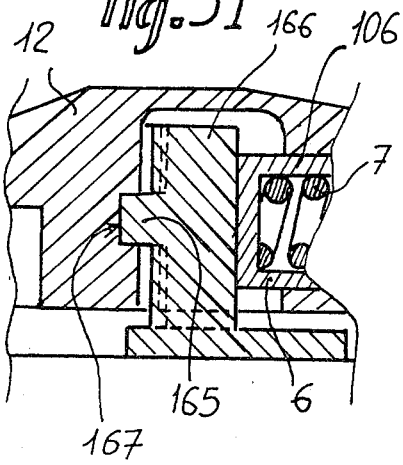
FIG. 31 is a partial vertical sectional view of another embodiment of the mode of support of the jaw on the fixed support means.
Figure 32:
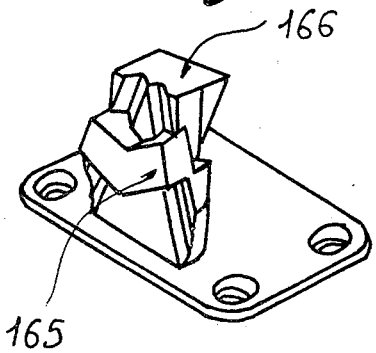
FIG. 32 is a perspective view of another embodiment of the fixed support means.

FIGS. 31 and 32 show an embodiment of vertical retention equivalent to that used according to FIGS. 8, 14, 15, 17.

FIG. 31 is a partial view similar to FIG. 8. In this embodiment, there is inversion of the projecting part and of the recessed part. The projecting retention part 165 (similar to 126—FIG. 14) is made on the support means 166 whilst the recessed part 167 (similar to 127—FIGS. 15–17) is made in the jaw 5.

What is claimed is:

1. A safety binding for a ski having a longitudinal plane of symmetry comprising a one-piece jaw in which can be engaged and maintained one end of the sole of a ski boot, support means connectible to said ski in front of said jaw and providing two lateral support lines disposed respectively on either side of the longitudinal plane of symmetry of the ski, resilient means urging the jaw against said support means at the support lines, said support means and jaw being engaged such that the jaw can pivot on either line of support, the lines of support viewed along the longitudinal axis of the ski converging towards a point disposed above the ski in order that in one direction of lateral movement of the jaw, the jaw will pivot about one line of support and in the other direction of lateral movement of the jaw, the jaw will pivot about the other line of support, and means for retaining said jaw on said support means while allowing limited upward movement of at least part of said jaw in the course of pivoting of the jaw around one of the support lines.

2. A safety binding according to claim 1, in which the two lines of support are symmetrical relative to the longitudinal plane of symmetry of the ski.

3. A safety binding according to claim 1, in which the means for retaining said jaw on said support means comprises a retaining projection between the upper part of the jaw and the upper part of the support, said projection being provided on one of these two parts.

4. A safety binding according to claim 1, in which the jaw has a front transverse face, and the support means has a rear transverse face, one of said transverse faces being provided with recesses and the other with projections engagable in the said recesses for defining the lines of support and permitting relative movement between the jaw and the support means.

5. A safety binding according to claim 4, in which the projections are constituted by ribs converging upwardly one towards the other and having rounded ends forming cylindrical surfaces of relatively small diameter to constitute the lines of support, and the recesses being formed by converging grooves subtending between them the same angle as the ribs.

6. A safety binding according to claim 4, in which the projections are constituted by lower and upper pairs of stems and the recesses are formed by lower and upper pairs of vertical grooves, the lower stems and the upper stems forming two pairs respectively located in planes parallel to the surface of the ski.

7. A safety binding according to claim 1, wherein said resilient means comprises a threaded rod and said jaw is journalled on the rear end of said threaded rod by a screw which is engaged in a tapped hole provided in said rear, said screw being engaged in a vertical recess provided in the face of the jaw facing the support means, and means for engaging the screw with the jaw to prevent removal thereof after assembly with the threaded rod, the threaded engagement of the screw with the threaded rod permitting control of the height of the jaw.

8. A safety binding according to claim 4, in which one of the transverse faces of the jaw and the support means is provided with a boss and the other with a recess receiving said boss in order to vertically retain said jaw on said support means.

9. A safety binding according to claim 8 in which the boss comprises two projecting sections defining respective upper retention flanges which extend in planes perpendicular to the axes of the ribs constituting the support lines.

10. A safety binding according to claim 4, wherein said support means comprises a body, said resilient means comprising a threaded rod with a spring in said body, and in which the jaw is articulated on the threaded rod which is urged towards the front of the ski by said spring, said threaded rod traversing a rear wall of the body through a hole provided therein, and the projections and recesses are such that they vertically retain the jaw on the support means.

11. A safety binding according to claim 10, in which the projections are constituted by a lower and an upper stem pairs, each of said stem pairs being respectively located in planes parallel to the surface of the ski, and the recesses are formed by two pairs of hollow parts in which said stems are respectively engaged, for vertically retaining said jaw on the support means.

12. A safety binding according to claim 10, in which the projections are constituted by a pair of conical ribs of which the axes are inclined forwardly with respect to the ski and converge above the ski, these two conical projections having their apices directed downwardly, and the recesses have conical shapes complementary of those of the projections.

13. A safety binding for a ski having a longitudinal plane of symmetry comprising a one-piece jaw in which can be engaged and maintained one end of the sole of a ski boot, support means connectible to said ski in front of said jaw and providing two lateral support lines disposed respectively on either side of the longitudinal plane of symmetry of the ski, resilient means urging the jaw against said support means at the support lines, said support means and jaw being engaged such that the jaw can pivot on either line of support, the lines of support viewed along the longitudinal axis of the ski converging towards a point disposed above the ski in order that in one direction of lateral movement of the jaw, the jaw will pivot about one line of support and in the other direction of lateral movement of the jaw, the jaw will pivot about the other line of support, and first and second co-acting means for retaining said jaw on said support means while allowing limited upward movement of at least part of said jaw in response to upward and pivoting forces exerted on the jaw around one of the support lines.

* * * * *

UNITED STATES PATENT AND TRADEMARK OFFICE

CERTIFICATE OF CORRECTION

PATENT NO. : 4,337,965

DATED : July 6, 1982

INVENTOR(S) : Georges Pierre Joseph SALOMON

It is certified that error appears in the above-identified patent and that said Letters Patent is hereby corrected as shown below: On the title page In the Abstract, line 6, "the" (second occurrence) should be --a--.

Column 2, line 24, "of" should be --in--.

Column 3, line 15, "will" should be --wall--.

Column 4, line 44, "rivetting" should be --riveting--.

Column 5, line 30, --face-- should be inserted after "transverse".

Column 7, line 59, "thickness" should be --thicknesses--.

Column 8, line 1, "FIG." should be --FIGS.--;
line 3, "whilst" should be --while--;
line 23, "161" should be --101--; and
line 64, "22" should be --23--.

Column 9, line 5, "whilst" should be --while--;
line 10, "whilst" should be --while--;
line 36, "whilst" should be --while--; and
line 45, "omits" should be --on its--.

Column 10, line 36, "whilst" should be --while--.

UNITED STATES PATENT AND TRADEMARK OFFICE

CERTIFICATE OF CORRECTION

PATENT NO. : 4,337,965

DATED : July 6, 1982

INVENTOR(S) : Georges Pierre Joseph SALOMON

It is certified that error appears in the above-identified patent and that said Letters Patent is hereby corrected as shown below:

In Figure 1 of the drawings, "20" should be --20a--.

In Figure 3 of the drawings, "20" should be --20a--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*